United States Patent [19]

Demeny et al.

[11] Patent Number: 4,749,306

[45] Date of Patent: Jun. 7, 1988

[54] FORMED CORRUGATED PLASTIC NET FOR DRAINAGE APPLICATIONS

[75] Inventors: Darwin D. Demeny, White Bear Lake; Robert C. Slocumb, Edina, both of Minn.

[73] Assignee: Leucadia, Inc., New York, N.Y.

[21] Appl. No.: 904,556

[22] Filed: Sep. 5, 1986

[51] Int. Cl.[4] ..... E02B 11/00

[52] U.S. Cl. ..... 405/45; 405/50

[58] Field of Search ..... 405/36, 43, 45, 50, 405/48; 52/169.5, 169.14

[56] References Cited

U.S. PATENT DOCUMENTS

| | | | |
|---|---|---|---|
| 3,252,181 | 5/1966 | Hureau . | |
| 3,384,692 | 5/1968 | Galt et al. . | |
| 3,563,038 | 2/1971 | Healy et al. . | |
| 3,654,765 | 4/1972 | Healy et al. . | |
| 3,700,521 | 10/1972 | Gaffney . | |
| 4,490,072 | 12/1984 | Glasser . | |
| 4,622,138 | 11/1986 | Wager | 405/50 X |

FOREIGN PATENT DOCUMENTS

| | | | |
|---|---|---|---|
| 143010 | 8/1983 | Japan | 405/50 |
| 160424 | 9/1983 | Japan | 405/50 |
| 2040655 | 9/1980 | United Kingdom | 405/50 |

OTHER PUBLICATIONS

Subsurface Drainage Matting brochure, published by American Enka Company.

Prefabricated Drainage Structure brochure, copyright 1984 by Mirafi, Inc.

Eljen® drainage structures, advertising brochure by Drainage Products, Inc.

*Primary Examiner*—David H. Corbin

*Attorney, Agent, or Firm*—Vidas & Arrett

[57] ABSTRACT

Corrugated net thermoformed in a variety of differently shaped upstanding projections disposed on opposing surfaces of the netting to provide flow channels for draining ground water.

9 Claims, 1 Drawing Sheet

FORMED CORRUGATED PLASTIC NET FOR DRAINAGE APPLICATIONS

DESCRIPTION

BACKGROUND OF THE INVENTION

This invention relates generally to prefabricated drainage units and more particularly to improved drainage matrices therefor in the form of corrugated thermoplastic netting. The corrugated netting is thermoformed to provide a plurality of upstanding projections, sometimes referred to as corrugations herein, providing flow channels through which ground water may drain.

As an alternative to aggregate drains, prefabricated groundwater drainage arrangements of the general type contemplated herein and referred to as prefabricated drainage units have been suggested in the art and are described in several U.S. Patents. These patents include U.S. Pat. No. 3,563,038 and U.S. Pat. No. 3,654,765; along with the various patents cited or otherwise referred to in those patents. Such units find use in road edge drains, wick or fin drains and foundation drains, among others.

SUMMARY OF THE INVENTION

The invention provides a matrix of flow channels formed from corrugated or otherwise formed thermoplastic netting. Typically, the desired forming of the sheet net is achieved when the planar net is thermoformed into a desired three-dimensional configuration. The formed netting itself is then covered on one or on both sides by a filter material to prevent the introduction of dirt and the like into the flow channels. Such formed net provides an important three-dimensional configuration or thickness dimension which is important in preventing blockage of the flow channels by the filter material due to inward pressing of the filter material in response to the high pressures to which prefabricated drainage units are ordinarily exposed.

These and other aspects of the invention will be more fully appreciated from consideration of the following detailed description taken in conjunction with the accompanying drawing.

DETAILED DESCRIPTION OF THE INVENTION

Figure 1:
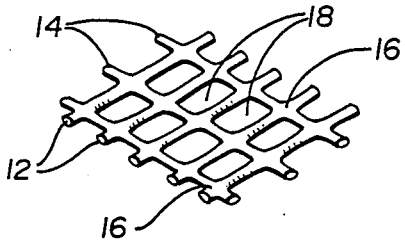
FIG. 1 is a perspective view of a specimen of extruded planar thermoplastic netting.

Referring first to FIG. 1, a portion of extruded plastic netting, shown generally at 10, is composed of parallel strands of plastic 12 and parallel strands 14 running perpendicular to strands 12 (machine and transverse directions, respectively), forming intersections 16, these intersections in turn defining gaps 18. The preferred netting shown at 10 is best formed using nylon, polyethylene, polypropylene, polystyrene or blends thereof, although other plastics may be used. A process for forming extruded net may be found for example in U.S. Pat. Nos. 3,252,181; 3,384,692 and 3,700,521, the contents of which are herein incorporated by reference. The extruded netting has typically been found to work best with high density polyethylene having about 10 strands per inch and weighing 150–200 pounds per square feet, although these parameters are not critical and may vary widely. A preferred strand count range is 6–12.

Figure 2:
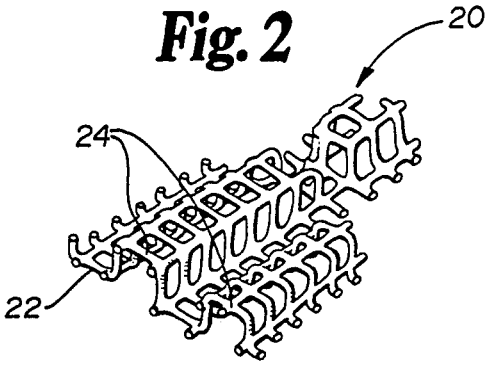
FIG. 2 a perspective view of a specimen of extruded thermoplastic netting formed into a three-dimensional corrugated shape of somewhat elongated rectangular channels or ribs.

FIG. 2 shows the extruded plastic netting 10 of FIG. 1 thermoformed into a rectangular three-dimensional corrugated channel embodiment, shown generally at 20, comprising spaced depressions or channels 22 adjacent to elevated channel-like raised areas 24. A preferred gap or distance across each elevated channel or spaced depression is approximately 0.75 inches. These dimensions are not critical and may vary. Occasional bridging areas **22*a*** may be included to interconnect channels.

Plastic net when thermoformed into a three-dimensional configuration according to the invention provides relatively high compressive resistance, for example, the embodiment of FIG. 2 provides compressive resistance on the order of 4,000 lbs/sq. foot at 20% compression. The process for thermoforming a sheet of extruded plastic netting such as is shown in FIG. 1 into the rectangular channel embodiment shown in FIG. 2 is best accomplished as follows. The plastic net is preheated. Infrared heaters are typically used for this purpose and are well known. The net is then passed between a pair of counter-rotating drums or cylinders which have on the surfaces thereof projecting areas of a configuration shaped to indent the plastic with any desired pattern, as for example the elongated rectangular channels shown. The projections on the cylinders may be arranged to intermesh similar to teeth on gears for best effect. Cold stamping may also be used for deformation.

Another technique which may be used involves a pair of oppositely disposed reciprocating plates or platens which carry the shapes of the raised projecting configurations and which may intermesh when brought together in mating contact with plastic net therebetween. Such a procedure does not allow continuous passage of the net and the net must be arranged for indexed movement during processing.

Figure 3:
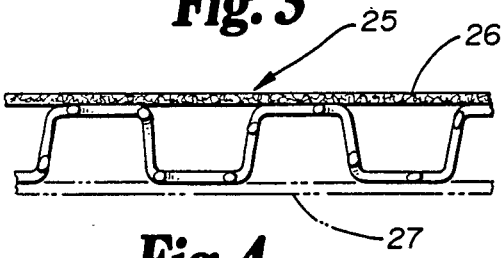
FIG. 3 is a sectional view across the ribbed profile of the embodiment of FIG. 2 having a filter fabric material applied to one side and a second optional layer of material shown in phantom applied to the opposite side.
Figure 4:
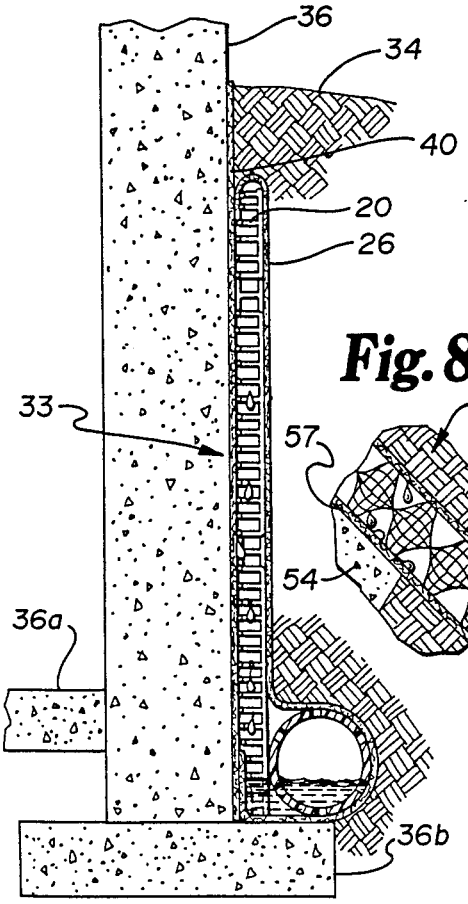
FIG. 4 is a sectional elevation of a typical foundation wall with the prefabricated drainage unit of FIG. 3 installed in a configuration to facilitate drainage of water downwardly along the outer surface of the wall to a drainage conduit at the base of the wall.

FIG. 3 shows generally at 25 a sectional view across the ribbed profile of the net of FIG. 2 i.e., the rectangular channel embodiment, covered by a layer 26 of filter fabric 26. The rectangular channel embodiment may optionally also be covered on its other side by a second layer 27 (shown in phantom) of filter fabric. Filter fabric material is attached to the net by any suitable adhesive or it may be heat bonded. Other means of attachment may be used as well. The material typically used as filter fabric is a synthetic fabric compatible with the environment in which it is to be used. The function of the fabric is to hold back solid particles that might clog the channels and other openings in the drainage unit. The fabric should be selected with this in mind. Such fabric materials are referred to in the art as "geotextile fabrics" and typically are made up of non-woven fibers such as polypropylene which have been melted and extruded into continuous filaments, then formed into layered sheets and punched with barbed needles that entangle the filaments in a strong bond. A preferred such material is available from Exxon Chemical Company, U.S.A., Houston, Texas 77001 as Exxon 130D. Another similar material is available from Crown Zellerbach, Nonwoven Fabrics Division, 3720 Grant Street, Washaugal, Washington 98671 marketed under the trademark FIBRETEX. These materials are available in a variety of weights and thicknesses. Typically, thicknesses of 50–150 mils are satisfactory for the purposes described herein. FIG. 4 shows generally at 33 the rectangular prefabricated drainage unit of FIG. 3 in place against a foundation wall 36 including floor 36*a* and footing 36*b*. The drainage unit is covered by earth 34. In between the drainage unit 33 and foundation wall 36 is a moisture barrier 40 as is well known in the art. As ground water penetrates the filter fabric 26, the filter fabric acting to prevent ground or dirt from entering drainage matrix 38, the water seeps downwardly through the drainage unit, through channels formed by the spaced depressions 22 and elevated channels 24, to ultimately be collected by drain conduit 44. The use of a drain conduit at the base of a foundation is well known in the art. The compressive resistance of the rectangular structure and the third dimension provided by the deformation of the net transverse to the net plane prevents the weight of the earth or hydrostatic pressure from compressing the drainage matrix and from forcing the filter material into the matrix to block the drainage channels.

Figure 5:
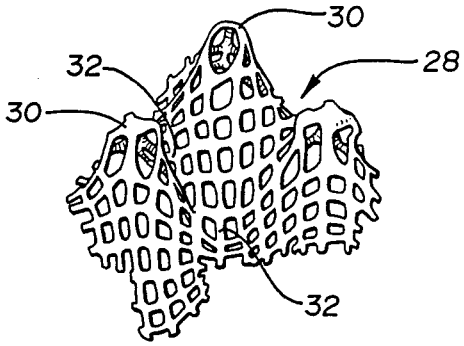
FIG 5 is a perspective view of a specimen of extruded thermoplastic netting formed into the shape of a plurality of alternating peaks to provide elevations and depressions, hereinafter referred to as cusps.

FIG. 5 shows generally at 28 the extruded plastic netting of FIG. 1 thermoformed into a three-dimensional drainage matrix composed of oppositely disposed cusp-like projections which form elevations 30 and cusp-like depressions 32. The process for forming such cusp-like netting is accomplished as already described hereinabove with respect to the embodiment of FIG. 2.

Figure 6:
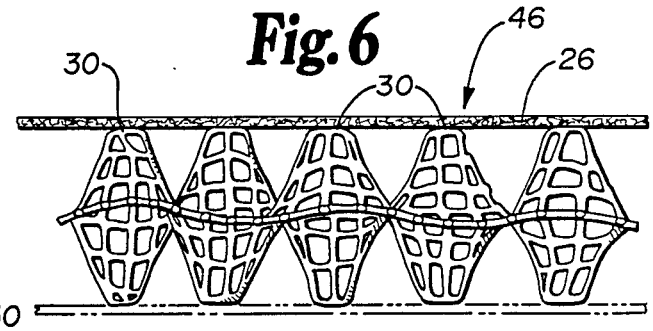
FIG. 6 is a sectional view across the profile of the embodiment of FIG. 5 having a filter fabric material applied to one side and a second layer of optional filter material shown in phantom applied to the opposite side.

FIG. 6 shows generally at 46, the embodiment of FIG. 5 covered with a layer of filter fabric 26. An optional layer of filter fabric shown in phantom at 27 may also be included. As with other embodiments, it may be held to the net with a suitable adhesive or by heat bonding. The cusp-like protrusions and depressions are arranged in a linear fashion. However, it is to be understood that the cusp-like projections and depressions may be arranged in many patterns. For example, they may be staggered in a variety of patterns. The filter fabric may be on one side to prevent dirt from entering the drainage matrix, or the filter fabric may be on both sides as already pointed out.

Figure 7:
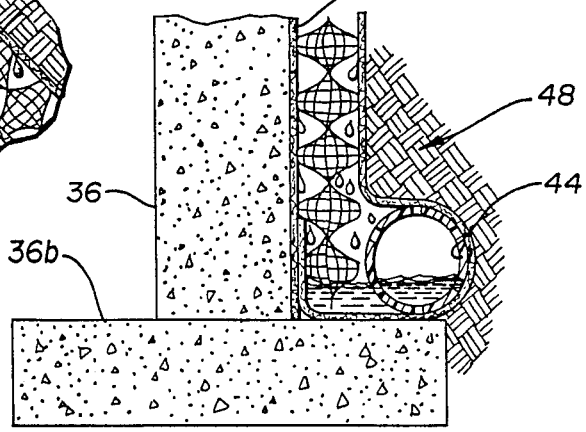
FIG. 7 is a partial sectional elevation of a typical foundation wall with the prefabricated drainage unit of FIG. 6 installed in a configuration to facilitate drainage of water downwardly along the outer wall surface to a drainage conduit at the base of the wall.

FIG. 7 shows generally at 48 the drainage unit of FIG. 6 in a configuration similar to that of FIG. 4. As the ground water drains through the drainage matrix, it is collected by drain conduit 44 and drained away from the concrete foundation.

Figure 8:
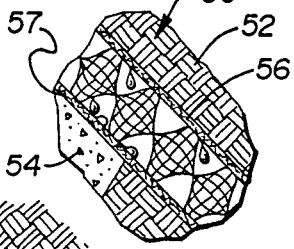
FIG. 8 is a detail sectional elevation of the prefabricated drainage unit of FIG. 6 used on an inclined surface along an inclined concrete base and inclined earth slope.

Referring now to FIG. 8 and shown generally at 50 is the cusp-like drainage unit of FIG. 6 arranged in an inclined fashion to assist the drainage along inclined earth 52 and concrete foundation 54. As shown, opposite layers of filter fabric 56 and 57 are attached to matrix 50.

While the preferred embodiments of the invention have been described herein, it will be apparent to those skilled in the art that various changes and modifications may be made without parting from the spirit of the invention as defined in the following claims.

What is claimed is:

1. A drainage unit, comprising: a flow channel matrix including on one or both sides thereof a substantially co-extensive fabric-like filter material, the matrix comprising planar extruded thermoplastic netting sheet which has been deliberately shaped so as to provide a plurality of three-dimensional upstanding projections on the opposing surfaces thereof such that a three-dimensional drainage matrix of improved relatively high compressive resistance is provided for the unit.

2. The drainage unit of claim 1 where the netting used for the matrix consists of a weight of about 150–200 pound/thousand square feet with about 6–12 strands per inch in the machine and transverse directions.

3. The drainage unit of claim 1 wherein the plastic netting for the matrix is selected from the group consisting of polyethylene, polypropylene, polystyrene, nylon and blends thereof.

4. The drainage unit of claim 1 in which the plastic for the matrix is high density polyethylene.

5. The drainage unit of claim 1 in which the projections take the form of elongated corrugations or channels.

6. The drainage unit of claim 5 wherein selected paired corrugations of the matrix are periodically interconnected by bridging deformed portions of the netting.

7. The drainage unit of claim 1 in which the thermoformed projections on the matrix are cusp-like in form.

8. The drainage unit of claim 7 in which the cusp-like projections of the matrix are arranged in a rectangular pattern.

9. The drainage unit of claim 13 in which the projections of each surface are off-set relative to each other.

* * * * *

UNITED STATES PATENT AND TRADEMARK OFFICE

CERTIFICATE OF CORRECTION

PATENT NO. : 4,749,306

DATED : Jun. 7, 1988

INVENTOR(S) : Demeney et al.

It is certified that error appears in the above-identified patent and that said Letters Patent is hereby corrected as shown below:

Column 4, line 58, "Claim 13" should read --Claim 8 --.

Signed and Sealed this

First Day of November, 1988

*Attest:*

*Attesting Officer*

DONALD J. QUIGG

*Commissioner of Patents and Trademarks*